US007934569B2

(12) United States Patent
Garcia et al.

(10) Patent No.: US 7,934,569 B2
(45) Date of Patent: May 3, 2011

(54) CORE STABILIZATION

(75) Inventors: Jean-Valery Sylvain Garcia, Aberdeen (GB); Philippe Cravatte, Aberdeen (GB)

(73) Assignee: Kirk Petrophysics Limited, Aberdeen (GB)

( * ) Notice: Subject to any disclaimer, the term of this patent is extended or adjusted under 35 U.S.C. 154(b) by 181 days.

(21) Appl. No.: 12/152,182

(22) Filed: May 13, 2008

(65) Prior Publication Data

US 2008/0283298 A1 Nov. 20, 2008

(30) Foreign Application Priority Data

May 14, 2007 (GB) ..... 0709223.2

(51) Int. Cl.
*E21B 25/06* (2006.01)

(52) U.S. Cl. ..... 175/59; 175/249

(58) Field of Classification Search ..... 175/58, 175/59, 249
See application file for complete search history.

(56) References Cited

U.S. PATENT DOCUMENTS

| | | | | |
|---|---|---|---|---|
| 4,071,099 | A * | 1/1978 | Hensel, Jr. | 175/59 |
| 4,716,974 | A * | 1/1988 | Radford et al. | 175/59 |
| 5,980,628 | A | 11/1999 | Hjelmeland et al. | |
| 6,443,243 | B1 * | 9/2002 | Griffin, Jr. | 175/59 |
| 6,681,873 | B2 * | 1/2004 | Griffin, Jr. | 175/58 |
| 2002/0129937 | A1 * | 9/2002 | Cravatte | 166/264 |
| 2006/0192033 | A1 | 8/2006 | Dansizen et al. | |

FOREIGN PATENT DOCUMENTS

EP 0 588 664 A2 3/1994

OTHER PUBLICATIONS

Kirk Petrophysics brochure, "Lithotarge Foam Injection", 2 pages, Kirk Petrophysics Ltd. (prior to May 2007).
Kirk Petrophysics web page, "Foam vs. Resin", 2 pages, http://kirkpetrophysics.homestead.com/FoamResin.html, Kirk Petrophysics Ltd. (May 11, 2007).
Kirk Petrophysics web page, "Comments on Freezing", 3 pages, http://kirkpetrophysics.homestead.com/Freezing.html, Kirk Petrophysics Ltd. (May 11, 2007).
Kirk Petrophysics web page, "Advantages of Lithotarge Foam Injection Process", 2 pages, http://kirkpetrophysics.homestead.com/Advantages.html, Kirk Petrophyscis Ltd. (May 11, 2007).
Safety Data Sheet "Lithotarge™- B(Polyol)-B2-Pur Spray Foam System", 5 pages, Kirk Petrophysics Ltd. (Jan. 8, 2006).
Safety Data Sheet "Lithotarge™- A(ISO) HFC Pur Foam System", 6 pages, Kirk Petrophysics Ltd. (Jan. 8, 2006).
Garcia, et al., "Laboratory Assessment if the Efficiency of the Lithotarge Core Stabilization Technique for Short Term Preservation", 1 page, *SCA* 2007 (prior to May 2007).
European Search Report, from EP 08251698.0, dated Jan. 31, 2011, 2 pages.

* cited by examiner

*Primary Examiner* — William P Neuder
(74) *Attorney, Agent, or Firm* — Drinker Biddle & Reath LLP

(57) ABSTRACT

A method of stabilizing a core sample is described, and an agent for use in the stabilising method. The method involves injecting a foam around a core sample in a cylindrical liner. The foam comprises mixture of a first pressurized polymerisable-based fluid and a second pressurized fluid, which are simultaneously injected as a foam into an annulus between the core sample and liner. The foam preserves the sample and cushions it for transportation. The foam can include a dye or colorant to distinguish the foam from other materials in the core sample.

10 Claims, 2 Drawing Sheets

CORE STABILIZATION

FIELD OF THE INVENTION

The present invention relates to stabilizing core samples extracted from reservoirs and more particularly, though not exclusively, to a method of stabilizing a core sample by injecting a stabilizing agent into the annulus between the core barrel and the sample.

BACKGROUND TO THE INVENTION

In oil and gas exploration and production, engineers require geological and petrophysical data on the hydrocarbon formation within a reservoir in order to evauluate the oil/gas yield and to determine the optimum drilling and extraction program. A technique commonly used to obtain petrophysical data is core sampling. It is the only method of making direct measurement of rock and fluid properties.

In this approach a well is drilled and at predetermined depths a core sample is taken. A core sampling tool is attached to the end of the drill string. The tool includes a core barrel on which is located a core bit being a cylindrical blade with teeth mounted on the forward circular end. As the drill string is rotated the teeth cut through the rock formation and a solid cylindrical rock sample is obtained. As the cutting occurs the sample enters the core barrel and passes into an inner tube or liner which carries the sample to the surface.

On the surface, the liner is extracted from the core barrel and divided into smaller sections for transportation to the laboratory. Known disadvantages of this technique is that the core sample can be damaged due to movement of the sample within the liner during transportation; the liner can flex causing unwanted fractures in the core sample; and soft friable sediments within the core sample may lose adhesion from the core and fall away, making sections of the core unsuitable for analysis.

In an attempt to overcome these disadvantages, various stabilizing techniques have been proposed to hold the core sample intact within the liner. In one technique, liquids such as resins or plasters (gypsum) have been injected into the annulus between the sample and the inner wall of the liner. Once set, the core sample is then prevented from moving in relation to the liner during transportation. However, this technique has a number of inherent disadvantages. As the core sample comprises a rock matrix including fractures and pores, the liquid mixtures enter these areas, forcing out at least some the hydrocarbon fluid content and water as it seeps through the sample. Thus the resin/plaster invades the pores. The injection pressure can also cause disruption and destruction of the rock formation rendering useless much analysis data collected in the laboratory. Yet further as these liquids work by gravitational drainage, they can only flow where there is a totally open annulus. As a result they have limited success where the core sample contains friable sediments.

An alternative technique for stabilizing core samples is freezing. This can be done in a freezer, using dry ice or dipping a core in liquid nitrogen. Besides the inherent difficulty in transporting the material and equipment to undertake freezing on a rig, the frozen sample must remain frozen, as any thawing will damage the core. Freezing cannot be used for samples from gas reservoirs and the method and local conditions are critical to the analysis of the core in the laboratory. If the core is frozen slowly, damage to grain boundaries results and measurements of resistivity, sonic velocity and permeability are affected. Additionally, there will be marked fluid migration which influences saturation determination and prevents chemical tracers being used on the core sample. Freezing at a faster rate to overcome the disadvantages of grain boundary damage and increased fluid migration, however, causes fracturing along thin bed boundaries due to the large thermal shocks experienced.

SUMMARY OF THE INVENTION

According to a first aspect of the present invention there is provided a method of stabilizing a core sample from an underground formation, the method comprising the steps:

providing a cylindrical liner for receiving a core sample;

accommodating a core sample within the cylindrical liner, thereby defining an annulus between the core sample and the cylindrical liner;

providing a first pressurized polymerisable-based fluid and a second pressurized fluid;

mixing the first pressurized polymerisable-based fluid and the second pressurized fluid together to form a foam; and injecting the first and second fluids into the annulus to form a layer of foam between the core sample and cylindrical liner.

Typically the steps of mixing the first pressurized polymerisable-based fluid and the second pressurized fluid together to form a foam and injecting the first and second fluids into the annulus to form a layer of foam between the core sample and cylindrical liner are carried out simultaneously.

By creating foam on entry to the annulus, the introduced mixture is lightweight and thus the damaging injecting pressure of liquids alone is alleviated. The process is also achieved outside the temperature freezing range and so preserves the sample. On setting of the foam the core is cushioned for transportation.

Typically the first and second fluids polymerise to form a polymeric material. The polymeric material can be polyurethane.

In a particular embodiment the first fluid is a polyol blend. Advantageously the first fluid includes a polyester polyol as this increases the shelf life of the fluid.

Optionally the second fluid includes diphenylmethane-4, 4'diisocyanate, isomers (1) and homologues(2), blending of (1) and (2) (PMDI). The second fluid may be referred to as an MDI blend.

Optionally the first and/or second fluids further include a blowing agent as is known in the art. Preferably the blowing agent is added to the first pressurized polymerisable-based fluid. Thus the said first fluid may comprise polyester polyol and 1,1,1,2 tetrafluoroethane. The first fluid may also include diethylene glycol tris(1-chloro-2-propyl)phosphate.

Such blowing agents assist in the creation of foam upon mixing. Advantageously each of the first and second fluids includes a blowing agent, and the percentage of blowing agent in each fluid is optionally different. The blowing agent may include 1,1,1,2-tetrafluoroethane.

Optionally each fluid is stored in a pressurized canister. Advantageously also nitrogen is put on each canister.

Typically the foam is settable by curing. By creating foam from the settable fluid, the fluid is urged into microfractures and coats the outer surface of the core as pores are sealed carrying the valuable hydrocarbon within. In this way a core sample stabilized by this method provides more realistic data on analysis.

At least one of the fluids may include a setting agent. The setting agent may control the time at which the settable fluid solidifies. Typically the foam cures within 1 to 2 minutes.

Advantageously at least one of the fluids may contain a colouring agent such as a dye or colourant. The colouring agent typically provides a colour to the foam to allow the set foam to be distinguished from other materials in the core sample. In some embodiments the dye mixes evenly through one of the fluids, thus creating foam of uniform colour. The colouring agent may be paint, particularly a polymeric paint such as polyol paint.

Optionally the method includes the step of connecting a hose between each canister and a spray gun. Optionally the gun provides a mixing chamber for the fluids. Additionally the gun may provide a handle for use by an operator to control the exit of the mixture from the gun. Optionally also the gun includes a nozzle sized to fit upon an entry port of the liner.

Optionally there is a plurality of entry and exit ports in the liner. In this way foam can be injected at several points along the core to ensure complete coverage of the annulus even when the annulus is not entirely open. Additionally drilling mud can be displaced by the injected foam and evacuated from the core through the exit ports as the foam drives the drilling fluid through the annulus.

According to a second aspect of the present invention there is provided a stabilizing agent for use in the method according to the first aspect, the agent comprising a urethane component, a polyol component, and a blowing agent.

The invention also provides stabilizing agent for use in the method according to the first aspect, the agent comprising at least two urethane polymer components, and a blowing agent.

Optionally the polyol component comprises a polyol blend, advantageously a polyester polyol as this increases the shelf life of the fluid.

The blowing agent, such as 1,1,1,2-tetrafluoroethane, may be added to the polyester polyol. The agent may also include diethylene glycol tris(1-chloro-2-propyl)phosphate.

In certain embodiments, the urethane component can include diphenylmethane-4,4'diisocyanate, isomers (1) and homologues(2), blending of (1) and (2) (PMDI). This component may be referred to as an MDI blend.

This blowing agent may include 1,1,1,2-tetrafluoroethane. Optionally the blowing agent is a CFC free blowing agent as is known in the art for creating foam.

Optionally the agent also comprises nitrogen.

Advantageously the agent also comprises a dye or colourant. The dye may be paint. In certain embodiments, the dye is polyol paint. A suitable paint is 'red paint PP398255'. The dye or colourant is typically soluble in the foam and the resultant mixture of the dye or colourant and the foam typically yields a foam with a uniform colour and with a colour density dependent on the ratio of dye (or other colourant) to foam and the colour intensity of the dye or colourant. Different colours of dye or colourant can be used, and in typical embodiments of the invention, the colour is selected to be a contrasting colour to the formation being sampled.

BRIEF DESCRIPTION OF THE DRAWINGS

An embodiment of the present invention will now be described by way of example only with reference to the accompanying drawings of which.

DESCRIPTION OF THE EMBODIMENTS OF THE INVENTION

Figure 1:
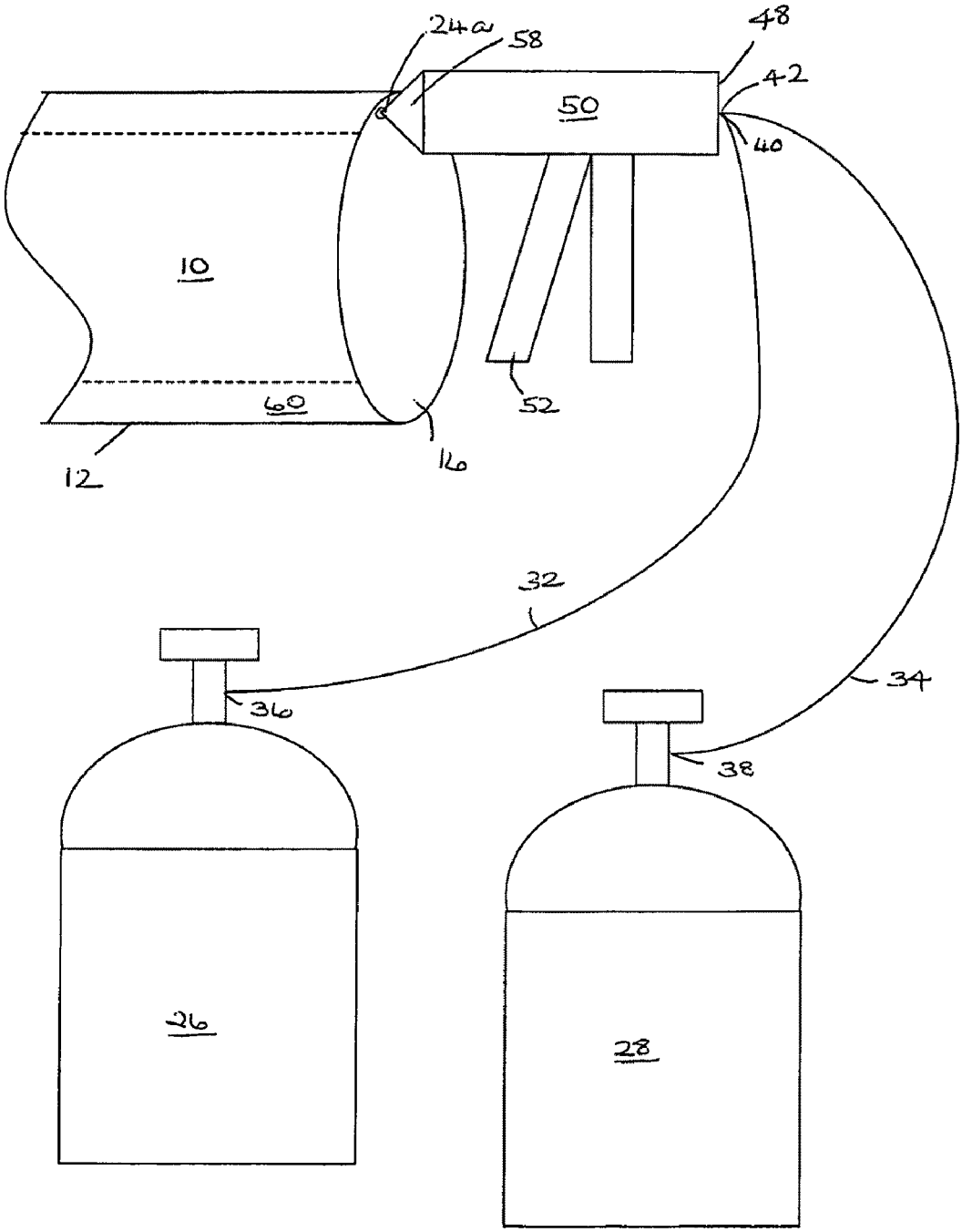
FIG. 1 is a schematic illustration of apparatus for stabilizing a core sample according to an embodiment of present invention.
Figure 2:
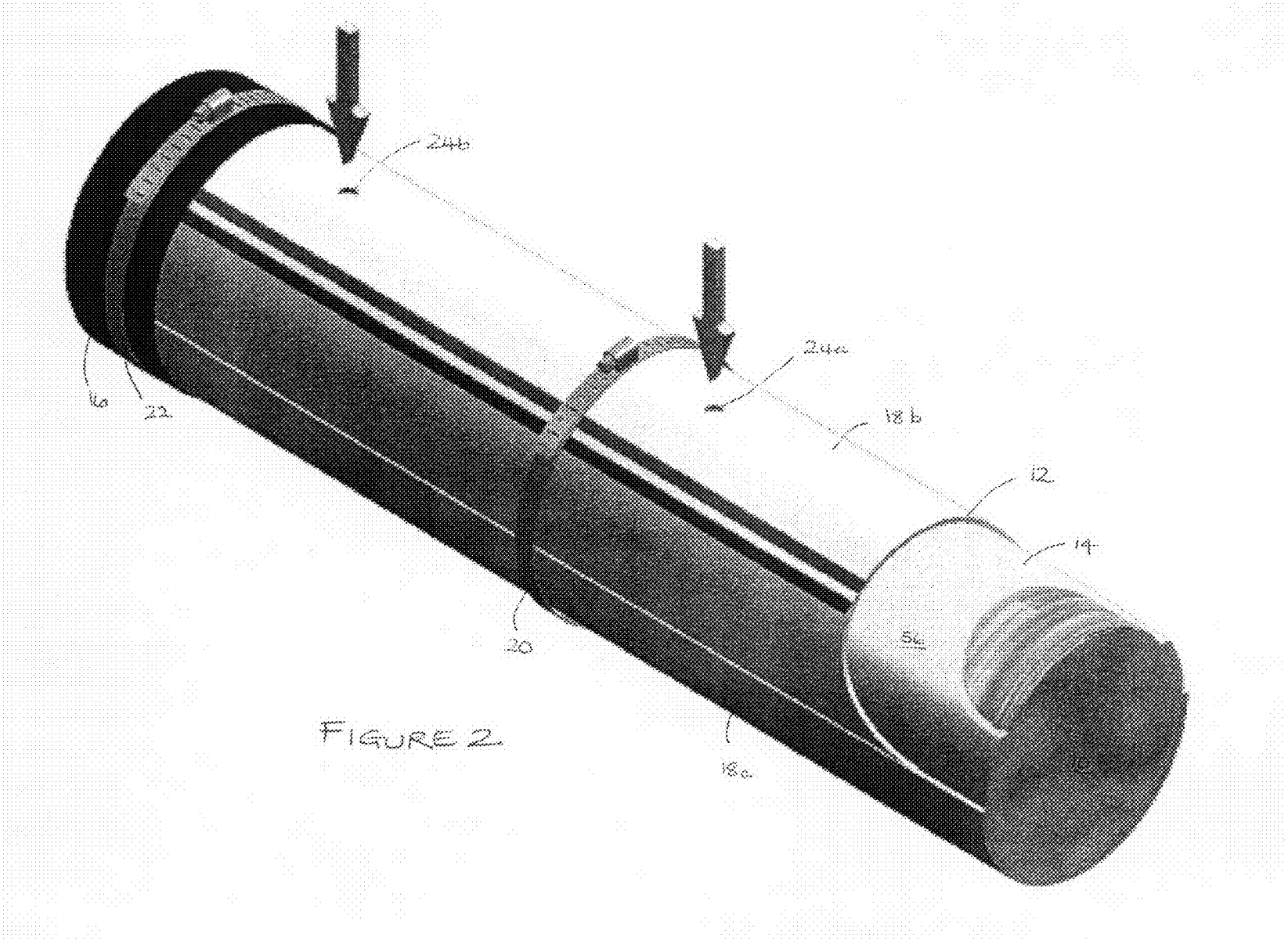
FIG. 2 is a schematic illustration of a core sample which is stabilized according to an embodiment of the present invention.

Referring initially to FIG. 1 there is illustrated a core sample, generally indicated by reference numeral 10, located within a liner 12 into which is being injected an agent 14 according to an embodiment of the present invention. Core sample 10 has been collected from an underground formation and brought to the surface in the liner 12. The liner is typically constructed of a fibre glass or aluminium tube. At surface the liner 12 is sealed via a cap 16 being located at each end thereof. As is illustrated in FIG. 2, the liner 12 may be formed from two semi circular portions 18*a,b* which are held together via a clamp 20, which may be a jubilee clip. While this arrangement allows easier access to the sample, those skilled in the art will recognise that a cylindrical tube is more commonly used. The end caps 16 may also be held in place by a clamp 22. Apertures 24*a,b* are located through the liner 12 and/or the end caps 16. The apertures 24 provide entry and exit ports.

The stabilizing agent 14 is brought to the site in two canisters 26, 28. The first canister 26 contains a polyol blend, a CFC free blowing agent, a red paint and nitrogen. The polyol blend in this embodiment is a polyester polyol comprising 1,1,1,2-tetrafluoroethane to which diethylene glycol tris(1-chloro-2-propyl)phosphate has been added. Typically the ratios are at 20-40% with 5-15% or 15-30% with 15-25% of each ingredient respectively.

Initially the polyol blend is mixed with the red paint until a uniform red color appears. The red paint is preferably PP398255, but may be any colorant or dye which turns the polyol blend a distinctive color. The mixing can be done in a closed canister 26 using a hand-mixer or a drill. A blowing agent (R134a) is then mixed into the polyol-red paint blend. Nitrogen is then injected into the pressurized canister 26 and the canister 26 is tumbled for around 15 minutes.

An MDI blend is filled in the second canister 28. The MDI blend includes diphenylmethane-4,4'diisocyanate, isomers (1) and homologues(2), blending of (1) and (2) (PMDI) together with 1,1,1,2-tetrafluoroethane if desired. Typically the ratio is 75-100% with 5-15%. The same blowing agent, but typically at a different percentage, is mixed into the MDI blend. Again nitrogen is injected into the canister 28 and the canister is tumbled for approximately 15 minutes.

The canisters 26,28 are typically pressurized ozone friendly canisters or cylinders which can be transported safely to the desired location.

Hoses 32,34 are connected to each canister 26,28 respectively at a first end 36,38. The opposing ends 40,42 of the hoses are connected to the inlet ports 44,46 at the rear 48 of a spray gun 50. A control lever 52 on the gun 50 releases the pressurised fluids in each hose 32,34 to mix together in a chamber 54 within the gun 50. On release and mixing, a polyurethane foam 56 is created which exits the gun 50 through the forward nozzle 58. In this embodiment, the components are mixed homogenously within the gun before injection, but in certain embodiments the components can be mixed simultaneously while being injected, for example while leaving or entering the nozzle of the gun 50, thereby obviating the requirement for the mixing chamber 54 within the gun 50.

An operator will begin by shaking the canisters 26,28 to ensure the components are thoroughly mixed. They will then initially test that foam is exiting the gun 50 correctly by spraying the mix into a bag or container. They can then position the nozzle 56 in an entry port 24*a* and pull on the trigger 52 to allow the foam 56 to enter the annulus 60 between the core sample 10 and the inner wall 62 of the liner 12. The foam will expand into the annulus to completely fill the annulus and enter any fractures with the core sample. Any drilling mud remaining on the core sample will be displaced, and driven out through the exit port 24*b*. To ensure full coverage of the annulus 60, the nozzle may be located in alternative entry ports, or exit ports 24 and foam spraying continued. In certain embodiments, the nozzle can be connected simultaneously to more than one entry port, to inject at spaced apart locations at the same time. The coverage is monitored by observing foam exiting ports 24 further along the liner 12.

The core sample 10 is thus encapsulated in foam with a small overburden pressure retained. The foam cures in less than two minutes and the core sample, with or without the liner 12 can be packaged and transported to the laboratory for analysis. The foam has a protective cushioning effect on the core integrity. As the foam sets in a short time scale, the quality and coverage of the foam is improved.

At the laboratory or on-site the core does not have to be slabbed for inspection, as is required in prior art resin methods. As the foam is non-invasive, petrophysical data measurement can be undertaken on the sample with more confidence. The foam is typically radio-translucent, and does not register on CT scans and thus clearer data recordal is possible. The foam can be removed easily from the sample by peeling and thus analysis and sampling can be done immediately. Windows can also be cut immediately through the foam and the liner so that photography of the uncut core is readily achievable in white or ultraviolet light. By coloring the foam, in this case the foam appears pink due to the red paint, fractures in the core sample are highlighted for easier analysis. Additionally, a suitably colored foam helps to differentiate minerals such as calcite, at macro-fracture scale, from the foam. It can also be difficult to distinguish uncolored foam from resins which are also characteristically yellow/brown in color, so with colored foam (in this example, a pink colorant which is uniform throughout the foam) there is a reduced risk of confusion as the foam is distinguished from the surrounding sample.

Embodiments of the present invention provide a method and agent for stabilizing core samples which is non-invasive by not invading pore space.

A further advantage of at least one embodiment of the present invention is that it provides a method and agent for stabilizing core samples which improves analysis of samples by providing a contrasting color to distinguish the stabilizing agent from components of the sore sample.

A further advantage of embodiments of the invention is that it can provide a method and agent for stabilizing core samples which allows for less movement of the core during the stabilization process and thus full nine meter core lengths can be stabilized before being cut into one meter lengths and this advantageously limits the potential for loss of integrity.

A further advantage of embodiments of the invention is that it can provide a method and agent for stabilizing core samples which can be used on cores taken using the half moon system and allows for full core inspection prior to shipment.

A further advantage of embodiments of the invention is that it can provide a method and agent for stabilizing core samples which is safer than the prior art resin systems as the canisters are sealed and safe to handle, a user does not have to mix solutions by hand and there are no specialized handling or disposal procedures required.

Various modifications may be made to the invention herein described without departing from the scope thereof. For instance, alternative polymer based foams may be used. Different dyes or colorants may be selected and typically provide uniform coloring of the foam.

The invention claimed is:

1. A method of stabilizing a core sample from an underground, formation, the method comprising the steps of:

a) providing a cylindrical liner for receiving the core sample;

b) accommodating the core sample within the cylindrical liner, thereby defining an annulus between the core sample and the cylindrical liner;

providing a first pressurized polymerisable-based fluid and a second pressurized fluid;

d) mixing the first pressurized polymerisable-based fluid and the second pressurized fluid together to form a foam; and e) injecting the first and second fluids into the annulus to form a layer of foam between the core sample and cylindrical liner;

wherein the first and second fluids are pressurized and mixed together in an injection gun before being injected into the liner.

2. A method as claimed in claim 1, wherein the steps of mixing the first pressurized polymerisable-based fluid and the second pressurized fluid together to form a foam and injecting the first and second fluids into the annulus to form a layer of foam between the core sample and cylindrical liner are carried out simultaneously.

3. A method as claimed in claim 1, wherein the foam sets after being injected into the annulus.

4. A method as claimed in claim 1, including the step of mixing a setting agent with the first and second fluids to control the setting time of the mixture.

5. A method of stabilizing a core sample from an underground formation, the method comprising the steps of providing a cylindrical liner for receiving the core sample;

accommodating the core sample within the cylindrical liner, thereby defining an annulus between the core sample and the cylindrical liner;

providing a first pressurized polymerisable-based fluid and a second pressurized fluid;

mixing the first pressurized polymerisable-based fluid and the second pressurized fluid together to form a foam;

injecting the first and second fluids into the annulus to form a layer of foam between the core sample and cylindrical liner; and mixing coloring agent with at least one of the first and second fluids, the coloring agent being selected from the group consisting of a dye and a colorant.

6. A method as claimed in claim 5, including the step of mixing the coloring agent uniformly with the fluids to achieve a consistent color density in the mixture.

7. A method of stabilizing a core sample from an underground formation, the method comprising the steps of:

providing a cylindrical liner for receiving the core sample;

accommodating the core sample within the cylindrical liner, thereby defining an annulus between the core sample and the cylindrical liner;

providing a first pressurized polymerisable-based fluid and a second pressurized fluid;

mixing the first pressurized polymerisable-based fluid and the second pressurized fluid together to form a foam; and injecting the first and second fluids into the annulus to form a layer of foam between the core sample and cylindrical liner;

wherein the fluids are contained in pressurizable canisters, connected by hoses to an injection gun, and the fluids are mixed in the injection gun prior to being injected.

8. A method of stabilizing a core sample from an underground formation, the method comprising the steps of:

providing a cylindrical liner for receiving the core sample;

accommodating the core sample within the cylindrical liner, thereby defining an annulus between the core sample and the cylindrical liner;

providing a first pressurized polymerisable-based fluid and a second pressurized fluid;

mixing the first pressurized polymerisable-based fluid and the second pressurized fluid together to form a foam;

injecting the first and second fluids into the annulus to form a layer of foam between the core sample and cylindrical liner; and providing at least one injection port and at least one exit port in the liner, and wherein the fluids are injected into the at least one injection port, and can exit the annulus through the at least one exit port.

9. A method as claimed in claim 8, wherein more than one injection port is provided in the liner, and the fluids are injected simultaneously into more than one injection port.

10. A method as claimed in claim 9, wherein more than one exit port is provided in the liner, and fluids leaving the annulus pass through more than one exit port.

* * * * *